US009457922B2

(12) United States Patent
Malenke et al.

(10) Patent No.: US 9,457,922 B2
(45) Date of Patent: Oct. 4, 2016

(54) FOOD PRODUCT ORIENTING AND LOADING APPARATUS

(75) Inventors: Mark E. Malenke, Sun Prairie, WI (US); Brian Charles Adamski, Pulaski, WI (US); Tod Wesley Heleniak, Green Bay, WI (US)

(73) Assignee: Kraft Foods Group Brands LLC, Chicago, IL (US)

( * ) Notice: Subject to any disclaimer, the term of this patent is extended or adjusted under 35 U.S.C. 154(b) by 429 days.

(21) Appl. No.: 13/594,120

(22) Filed: Aug. 24, 2012

(65) Prior Publication Data

US 2014/0053511 A1 Feb. 27, 2014

(51) Int. Cl.

| | |
|---|---|
| ***B65B 35/50*** | (2006.01) |
| ***B65B 35/56*** | (2006.01) |
| ***B65B 23/12*** | (2006.01) |
| ***B65B 35/58*** | (2006.01) |
| *B65B 5/06* | (2006.01) |

(52) U.S. Cl.

CPC ..... *B65B 35/50* (2013.01); *B65B 5/068* (2013.01); *B65B 23/12* (2013.01); *B65B 35/58* (2013.01); *B65B 5/064* (2013.01)

(58) Field of Classification Search

CPC ..... B65B 35/50; B65B 35/56; B65B 5/06; B65B 35/52; B65B 11/56

USPC ..... 53/247, 248, 447, 443, 446, 531, 539, 53/540, 542, 544

See application file for complete search history.

(56) References Cited

U.S. PATENT DOCUMENTS 3,785,544 A * 1/1974 Smith ..... 206/446
3,927,508 A * 12/1975 Campbell, III ..... B65B 35/44 198/408
4,067,433 A * 1/1978 Phipps ..... B65B 35/56 198/374
4,085,563 A 4/1978 Egee et al.
4,130,480 A * 12/1978 Loewenthal ..... B65B 57/20 209/551
4,135,345 A 1/1979 Egee et al.
4,626,234 A * 12/1986 Oxborrow ..... B31B 1/44 208/189
4,627,215 A * 12/1986 Walz ..... 53/246
4,712,356 A * 12/1987 Hardage et al. ..... 53/446
4,864,801 A 9/1989 Fallas
4,895,487 A * 1/1990 Fluck ..... B65B 23/12 414/403
5,035,315 A * 7/1991 Fukusaki ..... B65B 23/14 198/408
5,095,684 A * 3/1992 Walker ..... B65B 57/12 198/462.2
5,752,366 A * 5/1998 Wilfong ..... B65B 39/007 53/246
6,102,187 A * 8/2000 Stimpfl ..... B65B 19/34 198/382

(Continued)

FOREIGN PATENT DOCUMENTS

GB 2187175 A 9/1987
WO 2010026635 A1 3/2010

*Primary Examiner* — Andrew M Tecco
*Assistant Examiner* — Praachi M Pathak
(74) *Attorney, Agent, or Firm* — Fitch, Even, Tabin & Flannery LLP

(57) ABSTRACT

An apparatus and method for placing food products into a food tray are disclosed. The apparatus comprises at least one sleeve at least one sleeve having a first end configured to singly receive food products and an at least partially closed second end opposite the first end. The at least one sleeve has a first position where the food products are singly receivable through the first end to form a stack having a predetermined orientation in the at least one sleeve. The at least one sleeve is configured to rotate from the first position to a second position where the food products are positioned over the food tray and substantially simultaneously unloaded in the predetermined orientation through an opening positioned between the first and second ends into the food tray.

22 Claims, 11 Drawing Sheets

(56) References Cited

U.S. PATENT DOCUMENTS 6,117,472 A * 9/2000 Yonemaru ..... A21C 3/04 426/496
6,141,943 A * 11/2000 Hart ..... B65B 35/46 198/418.6
6,520,314 B1 * 2/2003 Seiling ..... A21C 15/00 198/375
6,536,599 B1 * 3/2003 Nielsen ..... A22C 25/12 209/540
6,543,989 B1 * 4/2003 Derenthal ..... B65B 23/14 414/790
6,808,361 B1 * 10/2004 Christy ..... B65G 57/32 198/418.9
7,462,012 B2 12/2008 Hart et al.
8,407,973 B2 * 4/2013 Finkowski et al. ..... 53/540
2004/0020167 A1 * 2/2004 Bertuzzi ..... B65B 5/10 53/446
2006/0000688 A1 * 1/2006 Monti ..... B65B 35/58 198/408
2006/0283150 A1 12/2006 Hart et al.
2011/0023417 A1 * 2/2011 Finkowski et al. ..... 53/443

* cited by examiner

FOOD PRODUCT ORIENTING AND LOADING APPARATUS

FIELD

Systems for loading food products into packaging, and more specifically, automated systems that load stacks of food products into packaging are described herein.

BACKGROUND

Food products are often provided to consumers in packaging such as food trays. It can be desirable to arrange the food products in the trays in a way that can be visually appealing to the consumers and in predetermined quantities. Manual orientation and placement of a desired number of food products into food trays can be unduly time consuming and ineffective for mass packaging.

To increase packaging efficiency, automated systems can be used to load the food products such as crackers into food trays. One type of automatic loading system releases the crackers down a ramp designed to guide the crackers sequentially into a compartment or cell of a food tray in a shingled stack. The loss of control over the crackers as they travel down the ramp is not desirable. For example, such loss of control can lead to damaged crackers and prevent consistent shingled arrangement of crackers in the cell of a food tray.

SUMMARY

A method of placing food products into food trays comprises: singly forming a stack of food products in a first position; rotating the stack from the first position to a second position to place the stack over a food tray; and substantially simultaneously depositing the stack from the second position into the food tray.

The present method advantageously can minimize the loss of control over the crackers between the depositing device and the target food tray such that the crackers are controlled until they are positioned in close proximity over the food tray. The controlled orientation and deposition of the crackers into the food tray advantageously can maintain the crackers in a desired orientation both prior to, and after the deposition of the crackers into the food tray. In addition, because the crackers do not uncontrollably slide down a ramp into the food tray, but are deposited into the food trays in a controlled manner, the possibility of crackers being damaged or broken is significantly reduced and/or eliminated.

Rotating the stack from the first position to the second position can include rotating the stack from a substantially vertical position to a substantially horizontal position.

In one approach, singly forming the stack of food products includes orienting the food products in a shingled orientation. The rotating the stack from the first position to a second position can include maintaining the stack of food products in the shingled orientation. The depositing the stack from the second position can include positioning the stack of food products in the shingled orientation in the food tray.

Rotating the stack from the first position to the second position can include bringing more of the food products in the stack closer to the food tray when in the second position as compared to when in the first position.

Singly forming the stack of food products in the first position can include providing a movable plate including at least one opening and moving the plate to a first position that permits the food products to singly pass through the at least one opening of the plate to form the stack of food products. The method can further comprise moving the movable plate to a second position where a portion of the food products separate from the stack of food products are positioned on the movable plate. Singly forming a stack of food products in a first position can further include providing a fixed plate and maintaining the portion of the food products within a hollow passage formed in the fixed plate.

An apparatus for placing food products into a food tray is also provided. The apparatus includes at least one sleeve having a first end configured to singly receive food products and an at least partially closed second end opposite the first end. The at least one sleeve has a first position where the food products are singly receivable through the first end to form a stack having a predetermined orientation in the at least one sleeve. The at least one sleeve is configured to rotate from the first position to a second position where the food products are positioned over the food tray and substantially simultaneously unloaded in the predetermined orientation through an opening positioned between the first and second ends into the food tray.

In one approach, the at least one sleeve can include at least one abutment surface configured to orient the stack of food products in a shingled orientation.

More of the food products can be positioned closer to the food tray when the at least one sleeve is in the second position as compared to when the at least one sleeve in the first position.

In one approach, the at least one sleeve can comprise at least first and second longitudinally extending portions configured to move away from one another to form the opening positioned between the first and second ends. The first and second portions can be biased toward the closed position. The first and second portions can be hinged relative to one another.

In one approach, the at least one sleeve can have a hollow interior with a cross-section with a shape preferably, through not necessarily, corresponding to the shape of the food product, such as circular, oval, square, rectangular, or other shapes.

The first position of the at least one sleeve can be substantially vertical and the second position of the at least one sleeve can be substantially horizontal.

In one approach, the apparatus can include a stop member configured to contact the at least one sleeve and restrict the at least one sleeve from rotating past the second position.

The apparatus can further include a movable plate including at least one opening and being movable from a first position that permits the stack of food products to singly enter into the at least one sleeve through the at least one opening of the plate, and a second position that restricts the stack of food products from entering the at least one sleeve. The movable plate can overlie at least a portion of the least one sleeve, and a portion of the food products separate from the stack of food products can be positioned on the movable plate.

DETAILED DESCRIPTION

An apparatus is provided that permits automatic and controlled stacking, orienting, and dispensing of food products into food trays in a predetermined, shingled orientation. The apparatus includes one or more rotatable sleeves that can open and close. The food products can be fed into the sleeves by a conveyor system. The sleeves are configured to orient the received food products in a substantially vertical stack having a shingled orientation. The sleeves are also configured to rotate into a substantially vertical position and open to dispense all of the shingled food products substantially simultaneously into a cell of a food tray such that the food products are arranged in a shingled orientation in the food tray. This apparatus provides improved control of the food products during stacking, orienting, and dispensing of the food products and results in a more consistent and reproducible arrangement of the food products in the food trays.

Figure 1:
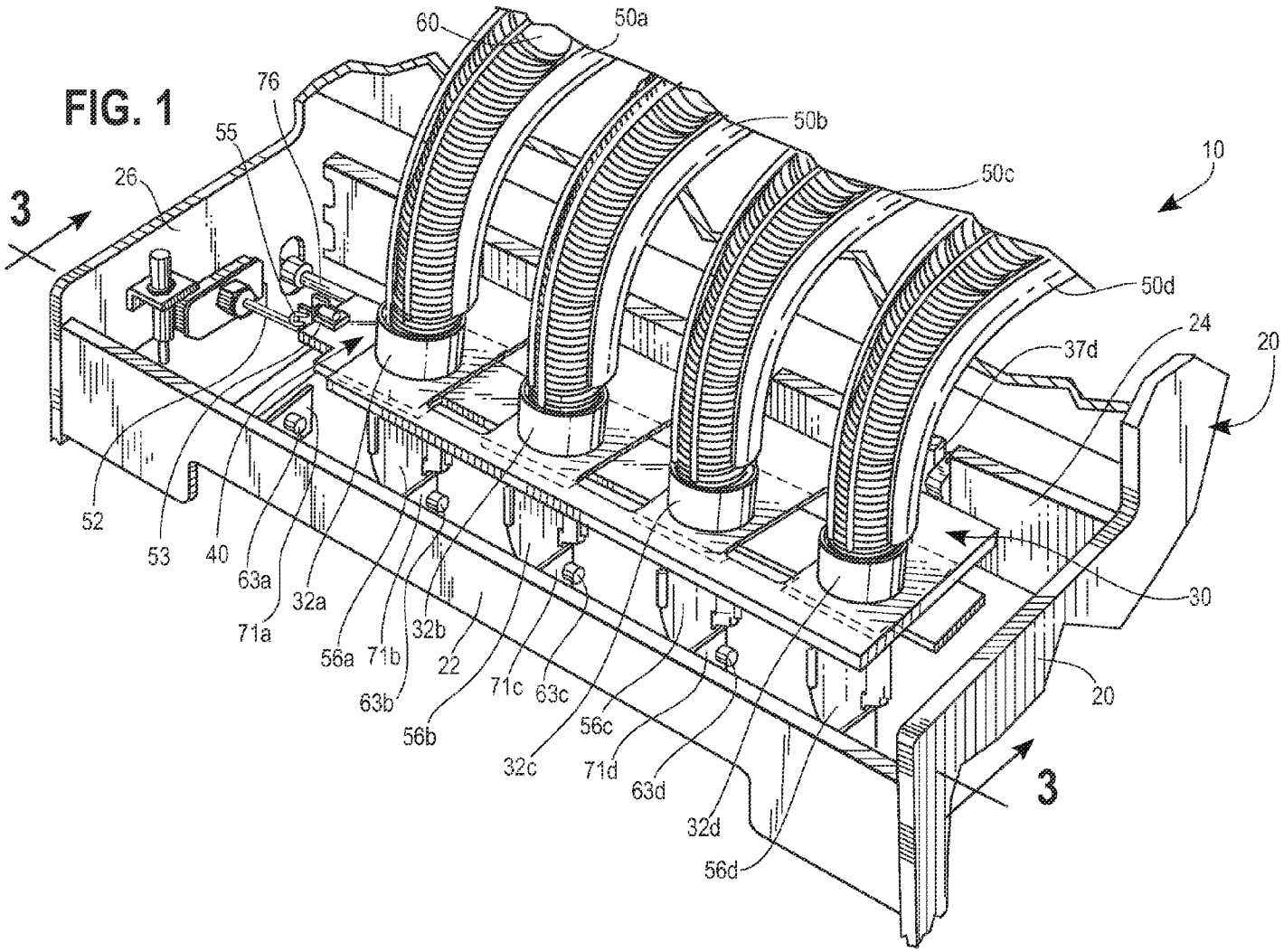
FIG. 1 is a perspective view of a selected portion of a food product stacking, orienting, and dispensing apparatus.

With reference to FIG. 1, an apparatus 10 is provided for stacking, orienting, and dispensing food products into a suitable receptacle such as a food tray having one or more compartments. A conveyor system having transport lanes or feed troughs 50*a*-50*d* supplies the food products 60 into the apparatus 10 as shown in FIG. 1. The food products 60 are received in rotatable chutes or sleeves 56*a*-56*d* of the apparatus 10, which are described in more detail below. It is to be appreciated that while the food products have been illustrated in the form of crackers 60, the food products also could be, for example, cookies, wafers, chocolates, meat slices or patties, and the like.

Figure 13:
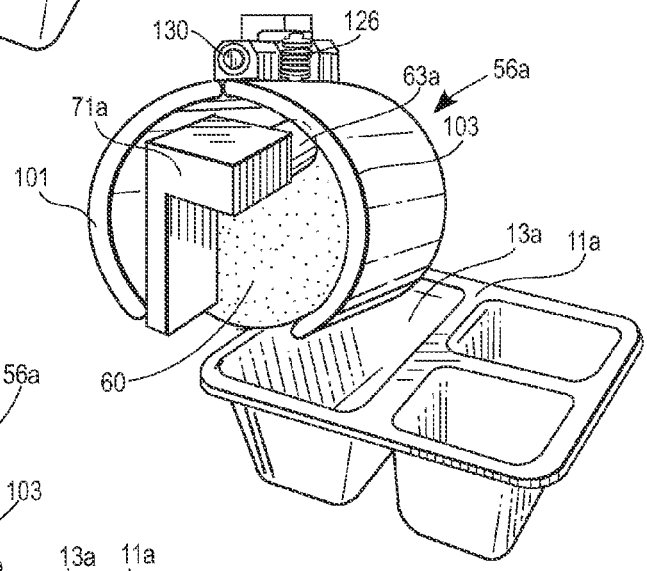
FIG. 13 is the same view as in FIG. 12, but with the rotating sleeve coming into contact with a stop member.
Figure 14:
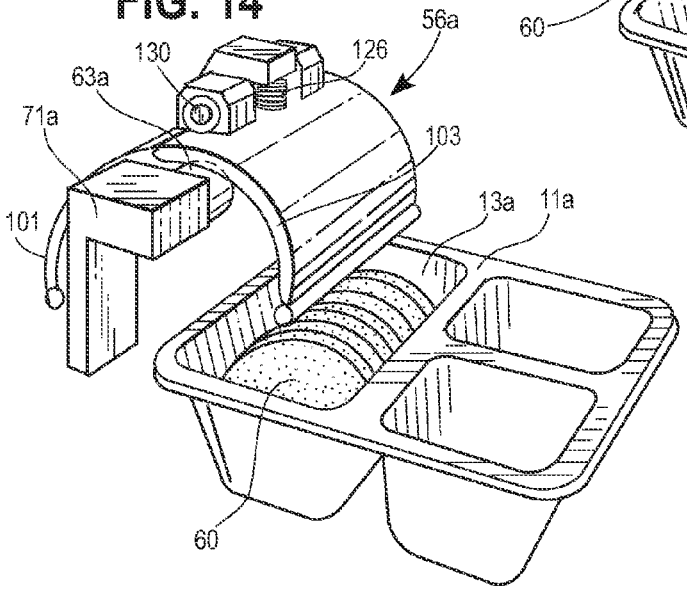
FIG. 14 is the same view as in FIG. 12, but with the rotating sleeve open and the food products dispensed into the food tray.

A method of placing food products 60 into food trays 11*a*-11*d* is provided. Generally, a stack of the food products 60 is singly formed in a first position as shown, for example, in FIG. 11. The stack of food products 60 is then rotated from the first position to a second position and placed over a food tray 11*a*, as shown in FIG. 13. The stack of the food products 60 is then substantially simultaneously deposited from the second position into the food tray 11*a* as shown in FIG. 14.

Figure 3:
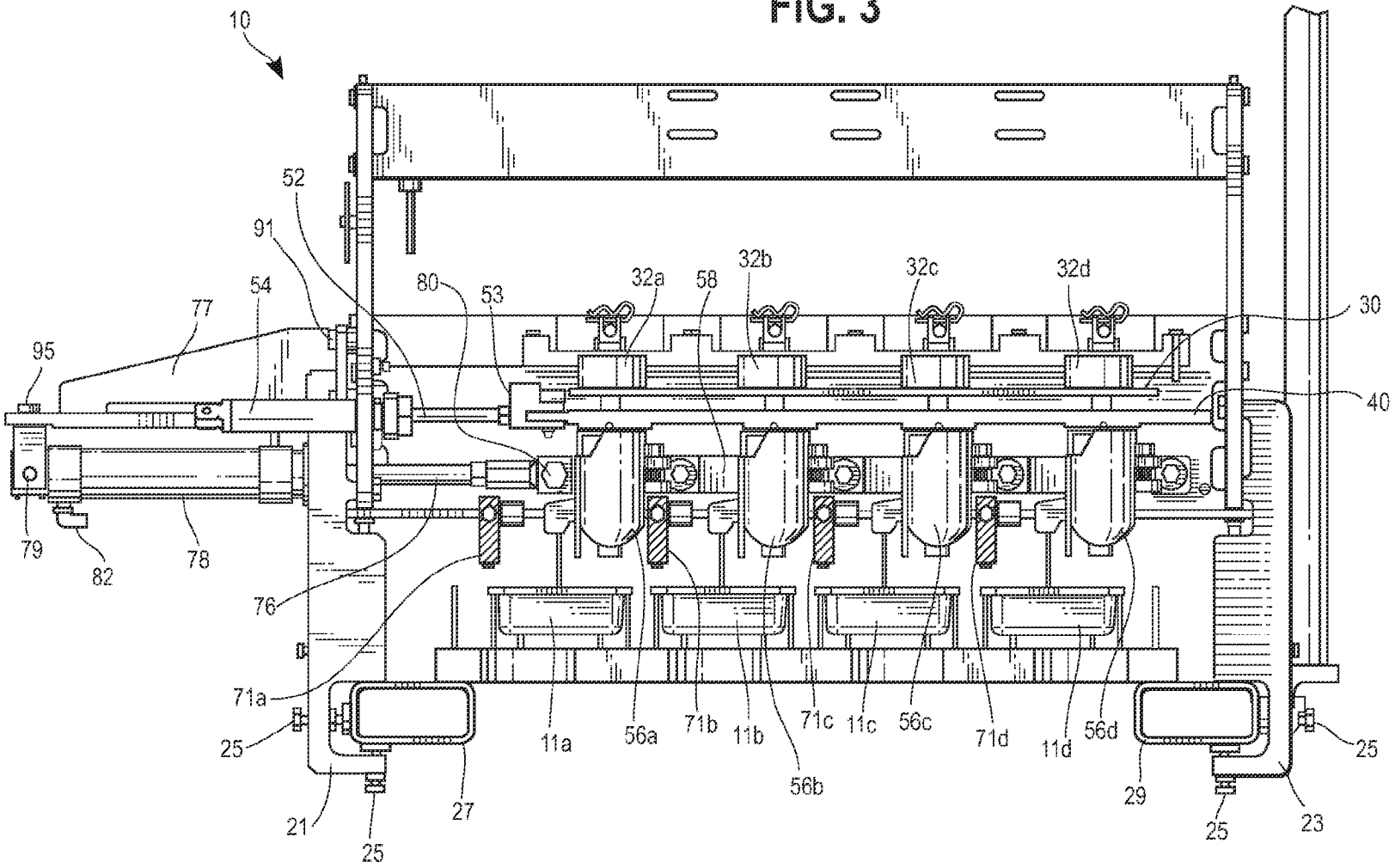
FIG. 3 is a front elevational view of the apparatus of FIG. 1, shown with a front wall removed for clarity, and with rotating sleeves in a food product receiving position.

When receiving the food products 60 from the feed troughs 50*a*-50*d* singly (i.e., one-by-one) to form the stacks of the food products 60, the rotatable sleeves 56*a*-56*d* of the apparatus 10 are in the first position, as shown in FIG. 3. The stacks of the food products 60 are oriented in a shingled orientation in the rotatable sleeves 56*a*-56*d* shown in FIG. 11 and described in more detail below. When depositing the stacks of the food products 60 into the food trays 11*a*-11*d*, the rotatable sleeves 56*a*-56*d* are positioned in the second position shown in FIG. 4. It is to be appreciated that a stack of the food products 60 can be positioned over the food tray 11*a* when in the first position as shown in FIG. 3.

The rotatable sleeves 56*a*-56*d* are configured to stack the food products 60 in a shingled orientation and to maintain control of the stacks of the food products 60 such that the shingled orientation of the stacks of the food products 60 can be preserved during the stacking, rotating, and depositing steps. Further, the rotatable sleeves 56*a*-56*d* position the stacks of the food products 60 in close proximity to the food trays 11*a*-11*d* such that when a stack of the food products 60 is deposited from the sleeve 56*a* into the food tray 11*a*, the stack maintains its shingled orientation in the food tray 11*a*, as shown in FIG. 14. It is to be appreciated that for purposes of this application, a "sleeve" will be understood to mean any structure for receiving the food products 60 and capable of generally maintaining the food products 60 in one or more predetermined orientations.

Figure 4:
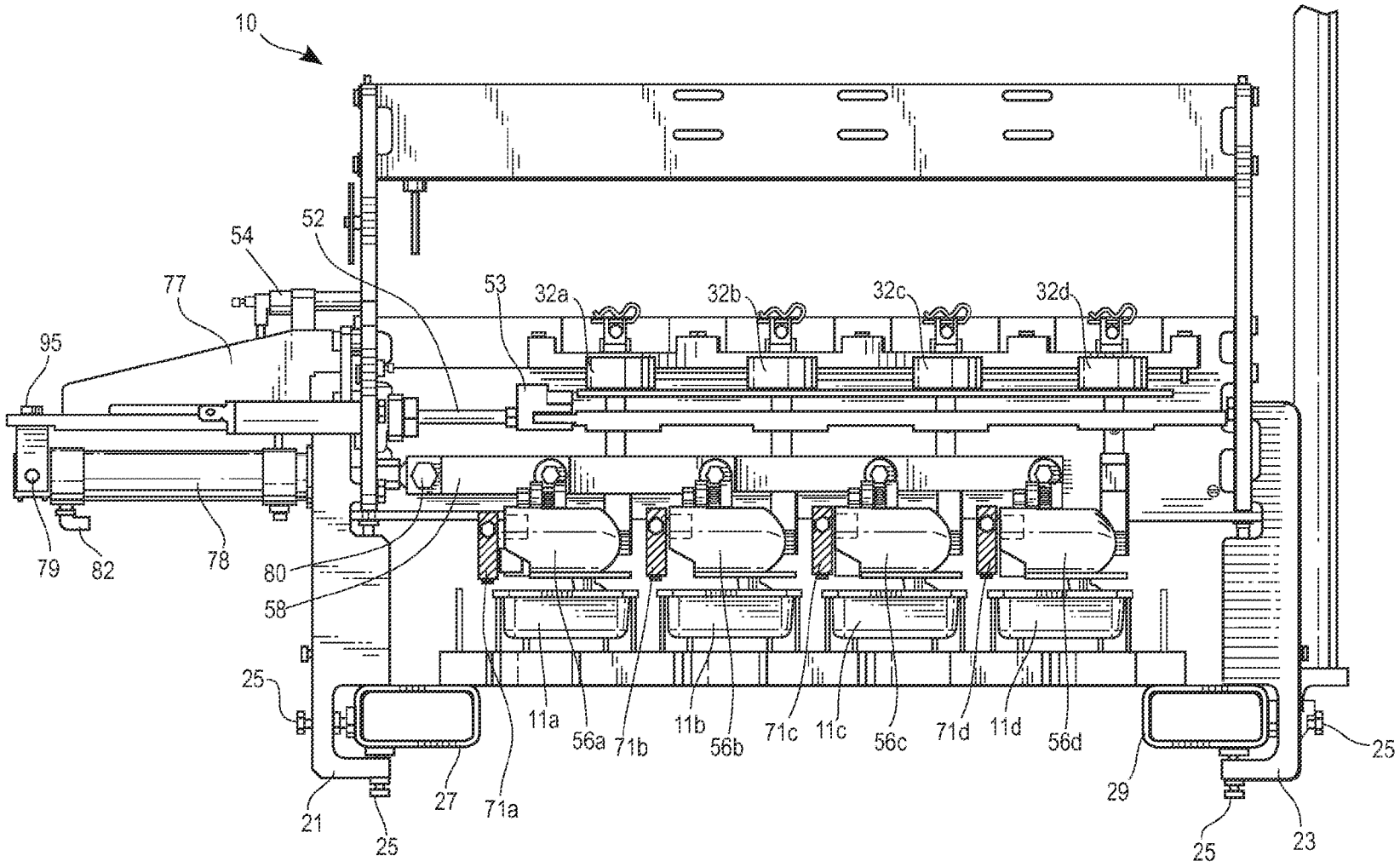
FIG. 4 is the same view as in FIG. 3, but with the rotating sleeves in a food product dispensing position.

The first position of the stacks of the food products 60 is substantially vertical (see, e.g., FIG. 3) and the second position of the stacks of the food products 60 is substantially horizontal (see, e.g., FIG. 4). "Substantially vertical" will be understood to mean a position that is more vertical than horizontal, i.e., an inclination that is greater than 45 degrees relative to the horizontal. "Substantially horizontal" will be understood to mean a position that is more horizontal than vertical, i.e., an inclination that is less than 45 degrees relative to the horizontal. When the stacks of the food products 60 are rotated within the sleeves 56*a*-56*d* from the first position to the second position, more of the food products 60 are brought closer to the trays 11*a*-11*d* when in the second position as compared to when in the first position.

With reference to FIGS. 1-6, the apparatus 10 is described. The apparatus 10 has a housing 20 including a front wall 22, a rear wall 24, a first side wall 26 and a second side wall 28. As shown in FIGS. 3 and 4, the first and second side walls 26 and 28 can include one or more clamping members 21 and 23, respectively. The clamping members 21 and 23 permit the apparatus 10 to be securely mounted, for example, via one or more fasteners 25 onto tray conveyor side surfaces 27 and 29, respectively.

Figure 6:
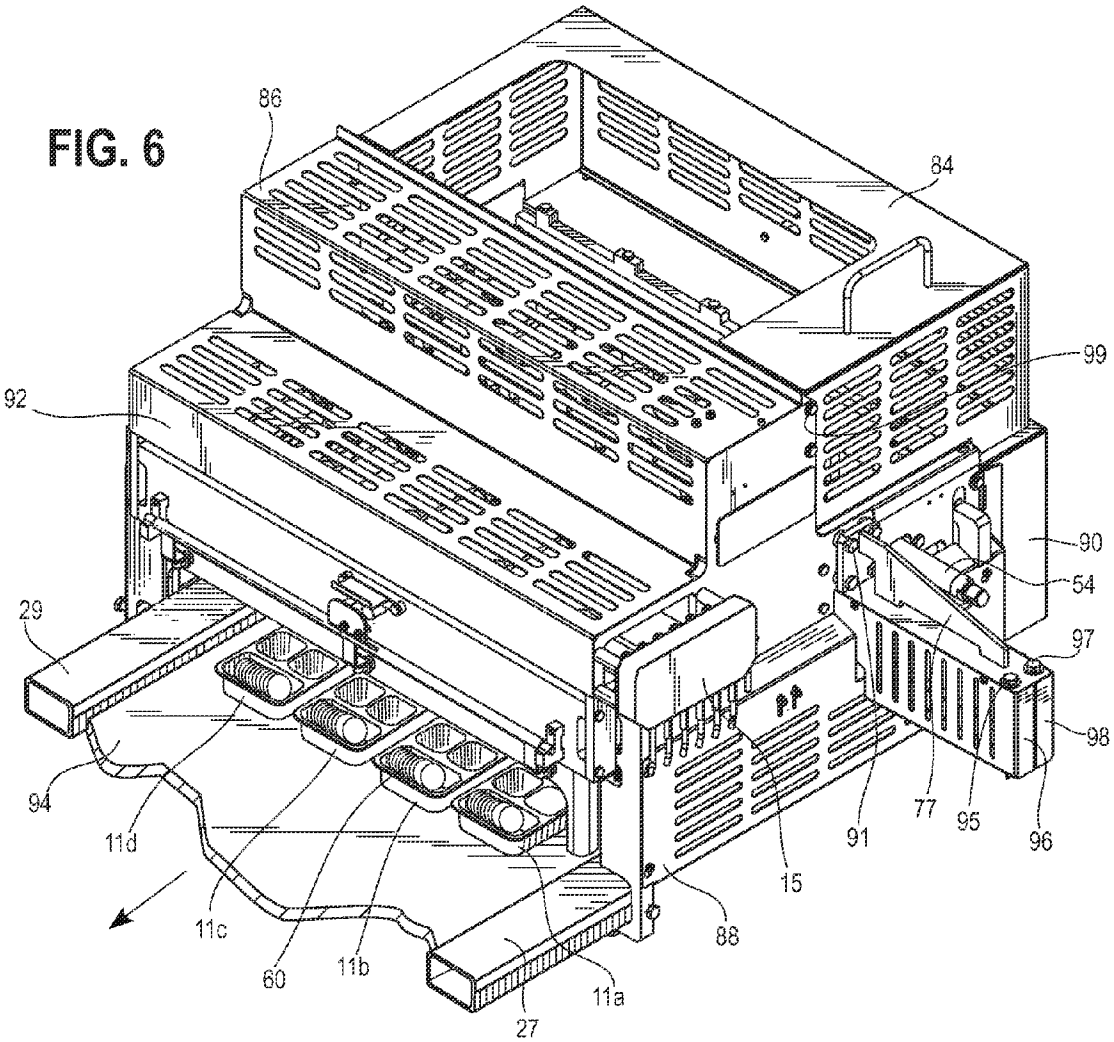
FIG. 6 is a perspective front view of the apparatus of FIG. 1, shown fully assembled with guard plates.

As shown in FIG. 6, a control box 15 can be mounted on the exterior the apparatus 10, for example, on the side wall 26. The control box 15 can be used to control at least a part of the functions of the apparatus 10. For example, the control box 15 can control the frequency of movement of various components within or outside of the housing 20. Optionally, an additional separate control panel or control station can be coupled to the apparatus 10 to control some or all of the functions of the apparatus 10.

Figure 2:
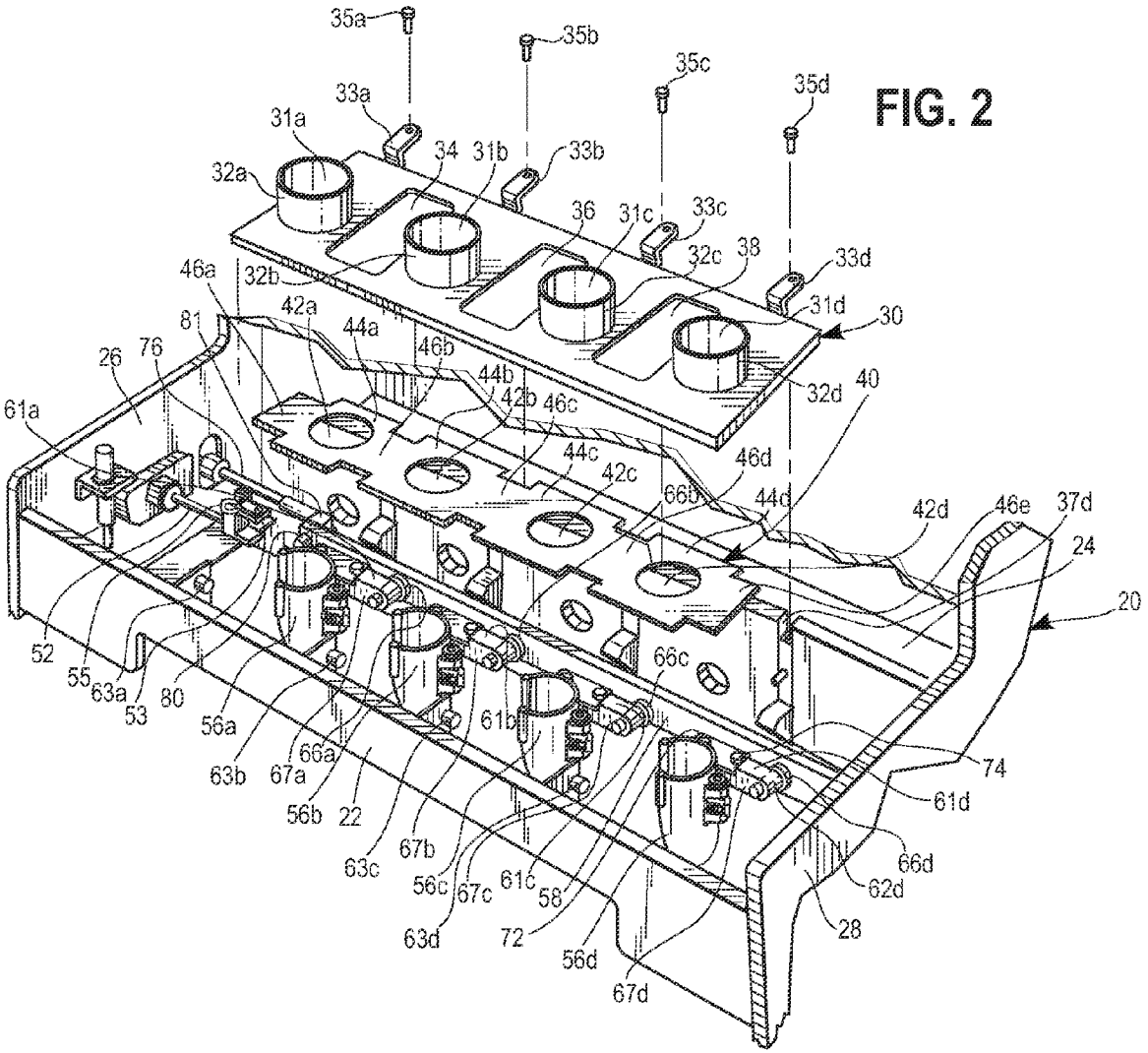
FIG. 2 is a perspective partial exploded view of the apparatus of FIG. 1, showing an accumulator plate and a shuttle plate in more detail.

With reference to FIGS. 1 and 2, the apparatus 10 includes an accumulator plate 30. The accumulator plate 30 can be generally rectangular and includes four accumulator cylinders 32*a*-32*d* projecting therefrom. The accumulator cylinders 32*a*-32*d* can receive the food products 60 from the conveyor feed troughs 50, and can temporarily store the food products 60 therein, as discussed in more detail below. The accumulator cylinders 32*a*-32*d* are generally round and each have a respective through opening 31*a*-31*d*, sized and shaped to form a passage that permits the food products 60 to pass therethrough. The accumulator plate 30 also includes three generally rectangular openings 34, 36, and 38 between the accumulator cylinders 32*a*-32*d*.

The accumulator plate 30 can be fixedly mounted on the rear wall 24 of the apparatus 10. In particular, the rear wall 24 can include four spaced recesses or slots 37*a*-37*d*. The accumulator plate 30 can include four slide clips 33*a*-33*d* aligned with and inserted into a respective one of the alignment slots 37*a*-37*d* such that the accumulator plate 30 can be secured to the rear wall 24 of the housing 20 by four fasteners 35*a*-35*d*, respectively, as generally shown in FIG. 2.

The apparatus 10 further includes a movable shuttle plate 40 positioned generally parallel to, and below the accumulator plate 30. It is to be appreciated that the shuttle plate 40 optionally could be non-parallel to, or positioned above the accumulator plate 30. The shuttle plate 40 includes four sections 44*a*-44*d* each having an opening 42*a*-42*d*, respectively. The openings 42*a*-42*d* are sized and shaped to match the size and shape of the respective openings 31*a*-31*d* of the accumulator cylinders 32*a*-32*d*. The shuttle plate 40 also can include five rectangular sections 46*a*-46*e* adjacent the sections 44*a*-44*d*. As shown in FIG. 2, the sections 44*a*-44*d* that include the openings 42*a*-42*d* have a greater width than the sections 46*a*-46*e*. It is to be appreciated that instead of having the narrowed sections 46*a*-46*e*, the shuttle plate 40 can have a rectangular perimeter and a constant width.

The shuttle plate 40 is coupled to a rod 52 of a reciprocating device such as an air cylinder 54 using, for example, an assembly including a retaining clip 53 and a locking pin 55, as shown in FIG. 1. The rod 52 of the air cylinder 54 can reciprocate between an extended position and a retracted position, causing the shuttle plate 40 to reciprocate between the positions shown in FIGS. 9 and 10, respectively. It will be appreciated that instead of the air cylinder 54, any other suitable reciprocating device can be used to move the shuttle plate 40.

With reference to FIG. 2 and as described above, the apparatus 10 also includes four rotatable chutes or sleeves 56*a*-56*d*. Each of the sleeves 56*a*-56*d* can be cylindrical and have a hollow interior 109 with a cross-section that is sized and shaped to match the size and shape of the openings 31*a*-31*d* of the accumulator cylinders 32*a*-32*d* and the openings 42*a*-42*d* of the shuttle plate 40. The sleeves 56*a*-56*d* are configured for receiving, stacking, orienting, and dispensing the food products 60 into a food receptacle as shown and discussed in more detail below.

It is to be appreciated that while the openings 31*a*-31*d* of the accumulator cylinders 32*a*-32*d*, the openings 42*a*-42*d* of the shuttle plate 40, and the cross-section of the hollow interior 109 of the sleeves 56*a*-56*d* have been shown as being circular to accommodate round food products 60, the openings 31*a*-31*d*, 42*a*-42*d*, and the hollow interior 109 of each of the sleeves 56*a*-56*d* can have any other shape suitable for accommodating non-circular food products. Such other shapes could be, for example, square, rectangular, triangular, oval, hexagonal, or the like. Furthermore, while the apparatus 10 has been illustrated with four sleeves 56*a*-56*d* configured to receive the food products 60 from four feed troughs 50*a*-50*d*, the apparatus 10 can include any (e.g., 1, 2, 6, 8, 10, or more) number of sleeves such as 56*a*-56*d* that receive the food products 60 from any corresponding number of transport troughs 50, and an accumulator plate 30 that includes an appropriate number (e.g., 1, 2, 6, 8, 10, or more) accumulator cylinders such as 32*a*-32*d* through which the food products 60 pass before they enter the sleeves 56*a*-56*d*.

Figure 5:
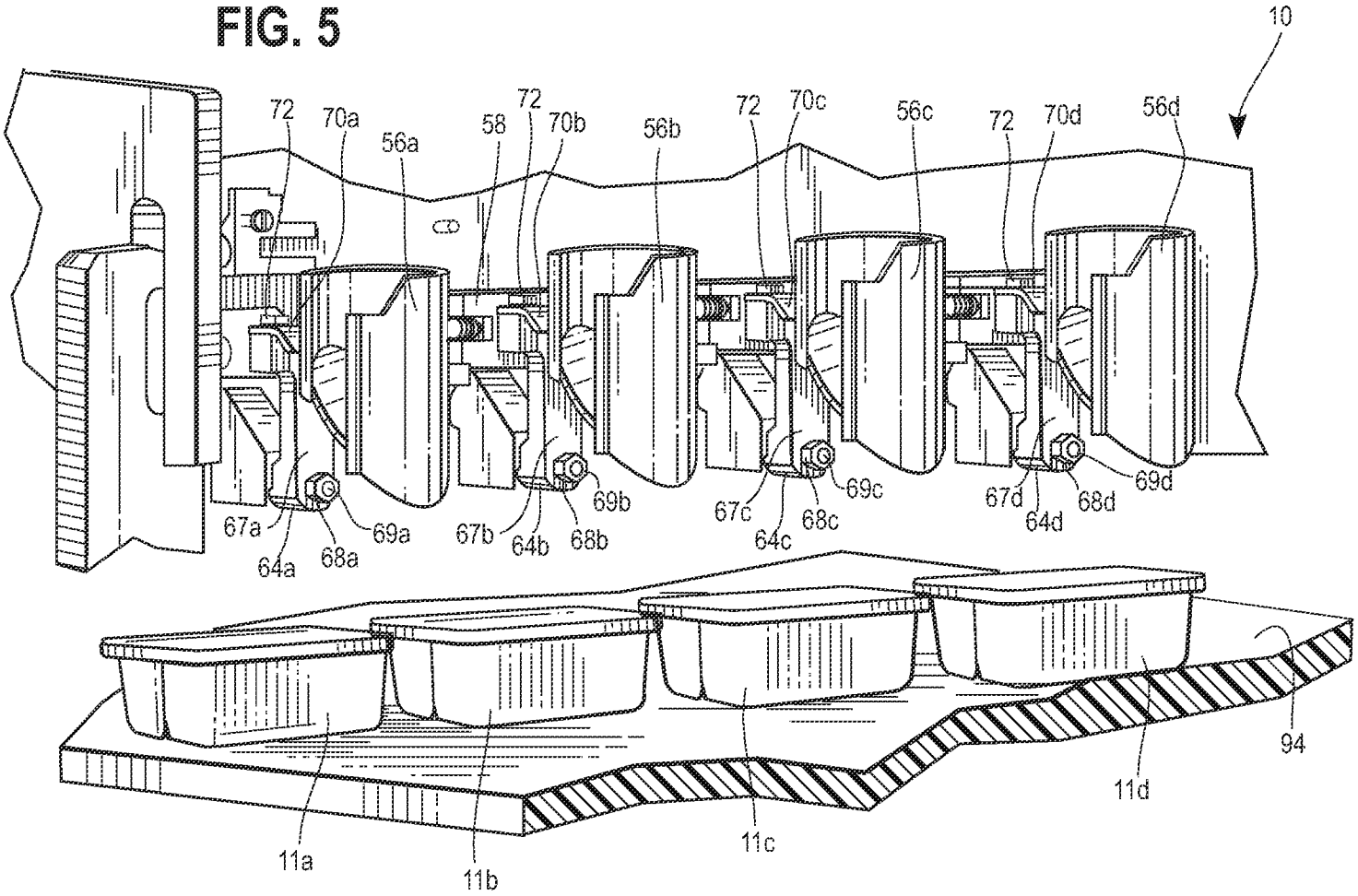
FIG. 5 is a perspective enlarged partial view of the apparatus of FIG. 1, showing the rotating sleeves in the food product receiving position and linkage members that provide for the rotation of the sleeves.

With reference to FIGS. 2 and 5, the sleeves 56*a*-56*d* can be coupled to a common linkage member 58 that extends in the interior of the housing 20 of the apparatus 10 in a direction generally parallel to the front and rear walls 22 and 24, respectively. The linkage member 58 can include four mounting brackets 67*a*-67*d* that can be rotatably coupled at their first ends 62*a*-62*d* to the linkage member 58 via one or more bushings 66*a*-66*d*. The mounting brackets 67*a*-67*d* can also be rotatably coupled at their second ends 64*a*-64*d* to the housing 20 via one or more fasteners 68 and/or bushings 69.

The mounting brackets 67*a*-67*d* of the linkage member 58 can be L-shaped and have a top surface 61*a*-61*d*, respectively, with a recessed portion that includes two fastener receiving openings. Each of the sleeves 56*a*-56*d* can include a bracket 70*a*-70*d* that also includes two fastener receiving openings. Each bracket 70*a*-70*d* can be positioned in a recessed portion of the top surface 61*a*-61*d* of a respective mounting bracket 67*a*-67*d* such that the fastener receiving openings of the brackets 70*a*-70*d* are aligned with the fastener receiving openings of the mounting brackets 67*a*-67*d*. The brackets 70*a*-70*d* of the sleeves 56*a*-56*d* can be coupled to the mounting brackets 67*a*-67*d* of the linkage member 58 via two fasteners 72 and 74 as shown in FIGS. 2 and 5 that pass through the openings in the brackets 67*a*-67*d* and 70*a*-70*d*.

The linkage member 58 is coupled to a rod 76 of an air cylinder 78. For example, a fastener 80 such as a screw or a bolt can pass through coaxial openings in the linkage member 58 and cylinder rod 76, with a nut 81 being tightened via the fastener 80 to the cylinder rod 76, as shown in FIG. 2. The air cylinder 78 can be positioned at least in part outside of the housing 20 of the apparatus 10, as shown in FIGS. 3 and 4. The air cylinder 78 has an inlet port 82 which permits the air cylinder 78 to be coupled via a tube or a hose to an air source such as an air generator. It is to be appreciated that instead of the air cylinder 78, any other suitable reciprocating device can be used to cause the reciprocating movement of the linkage member 58.

The cylinder rod 76 of the air cylinder 78 can reciprocate between an extended position shown in FIG. 3 and a retracted position shown in FIG. 4. Since the cylinder rod 76 is coupled to the linkage member 58, reciprocation of the cylinder rod 76 causes the linkage member 58 to reciprocate. When the linkage member 58 moves toward the retracted position, the linkage member 58 causes the mounting brackets 67*a*-67*d* to rotate about one or more of the bushings 66*a*-66*d* and 69*a*-69*d*, respectively, resulting in the rotation of the sleeves 56*a*-56*d* from the substantially vertical position shown in FIG. 3 to the substantially horizontal position shown in FIG. 4.

The apparatus 10 further includes four brackets or plates 71*a*-71*d* mounted to an interior surface of the front wall 22. Each bracket 71*a*-71*d* includes a respective abutment or stop member 63*a*-63*d* extending therefrom as shown in FIG. 1. The stop members 63*a*-63*d* can be knobs or cams and provide an abutment structure that can restrict the rotation of the sleeves 56*a*-56*d* downward past the second position shown in FIG. 4, as will be discussed in more detail below.

With reference to FIG. 6, the apparatus 10 can include a plurality of guards that can restrict access to an interior of the housing 20 and protect an operator from being injured during the operation of the apparatus 10. For example only, the apparatus 10 can include a top rear guard member 84, a top front guard member 86, a first side guard member 88, a second side guard member opposite the first side guard member 88, a bottom rear guard member 90, and a bottom front guard member 92.

The portion of the air cylinder 78 external to the housing 20 can be coupled to an L-shaped bracket assembly 77 via a pin 79, which can be a clevis pin as shown, for example, in FIG. 3. The L-shaped bracket assembly 77 can be attached to the side wall 26 of the housing 20 via the fasteners 91 as shown in FIG. 6. Two guard members 96 and 98 can be mounted to the bracket assembly 77 via respective fasteners 95 and 97 to cover the air cylinder 78 as shown in FIG. 6. The guard members 84, 86, 88, 92, 96, and 98 can be made of metal and are removably coupled to the housing 20 via a plurality of fasteners 99. The guard members 84, 86, 88, 92, 96, and 98 can be uncoupled from the housing 20, if necessary, to provide access to the interior of the housing 20, for example, for maintenance purposes.

Figure 8:
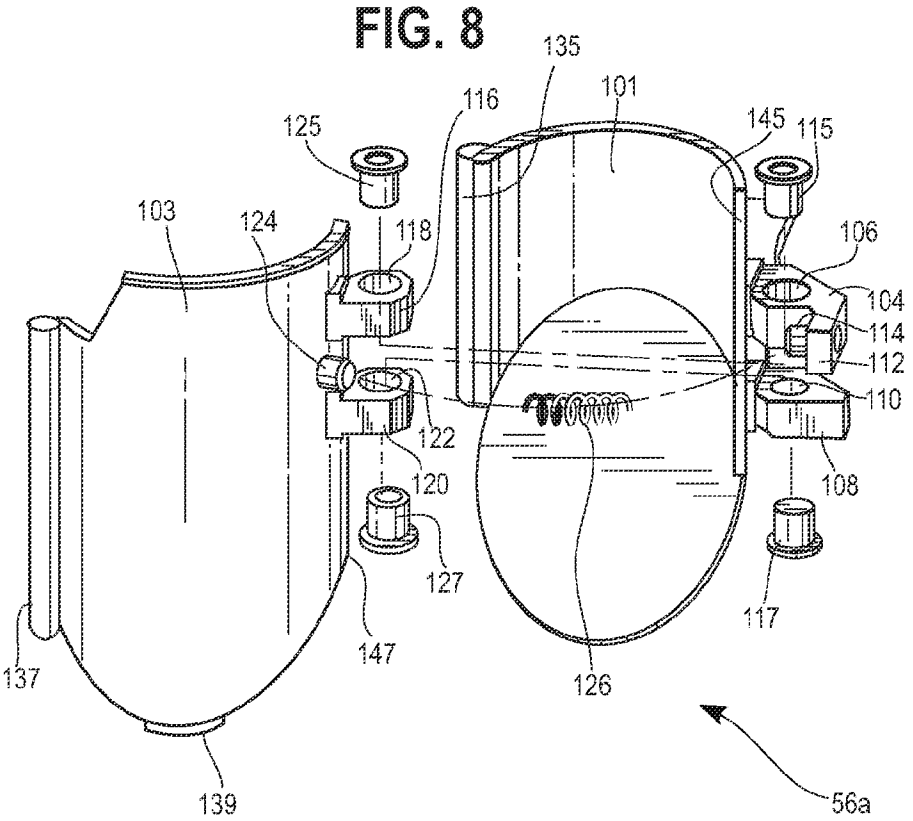
FIG. 8 is a side perspective partially exploded view of the rotating sleeve.
Figure 7:
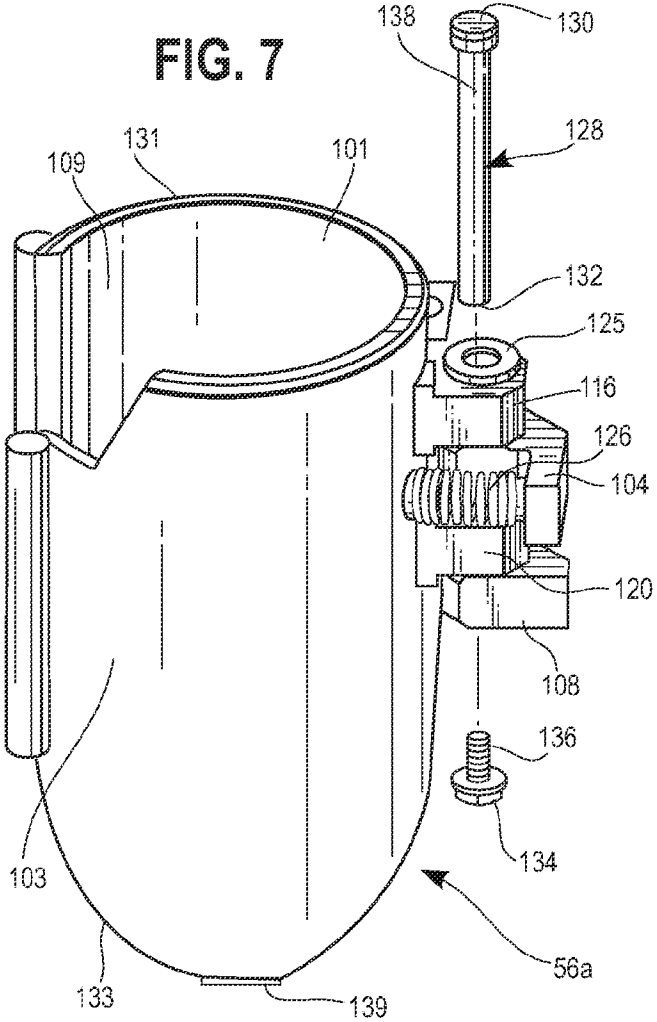
FIG. 7 is a side perspective view of the rotating sleeve, shown with exploded portions of a hinge assembly.

With reference to FIGS. 7 and 8, the structure of the sleeves 56*a*-56*d* of the apparatus 10 is described, with only the sleeve 56*a* being illustrated, since the sleeves 56*b*-56*d* are identical to the sleeve 56*a*. It is to be appreciated that while the sleeves 56*b*-56*d* have been illustrated as being identical to the sleeve 56*a*, the apparatus 10 can have one or more sleeves that are different from the sleeve 56*a*, allowing the apparatus 10 to simultaneously orient and dispense differently shaped food products into different trays on the conveyor.

The sleeve 56*a* comprises longitudinally extending portions or sleeve members 101 and 103 that are coupled to each other and have a hollow interior 109 therebetween. The hollow interior 109 can have a circular cross-section as shown, for example, in FIG. 7. The sleeve members 101 and 103 can be coupled by a hinge or another suitable connection that permits the sleeve members 101 and 103 to pivot relative to each other.

The sleeve 56*a* has a proximal end 131 that is open and forms an entrance into the hollow interior 109, and a distal end 133 opposite the proximal end 131. The sleeve 56*a* includes an abutment surface or projecting member 139 that at least partially obstructs the distal end 133 as described in more detail below. The first sleeve member 101 can be generally C-shaped and has an upper edge 145 and a lower edge 135. The first sleeve member 101 includes a first pivot linkage member 104 having an opening 106 and a second pivot linkage member 108 having an opening 110. The pivot linkage member 104 can include a projecting flange 112 with a downwardly extending pin 114.

The second sleeve member 103 also can be generally C-shaped and has an upper edge 147 and a lower edge 137. The second sleeve member 103 includes a first pivot linkage member 116 including an opening 118, a second pivot linkage member 120 including an opening 122, and an upwardly extending pin 124 positioned between the first and second pivot linkage members 116 and 120. Bushings 115, 117, 125, and 127 can be inserted into the openings 106, 110, 118, and 122 of the pivot linkage members 104, 108, 116, and 120, respectively, as shown in FIG. 8.

With reference to FIG. 7, the first and second sleeve members 101 and 103 can be coupled to each other by a pivot pin 128 passing through the bushings 115, 117, 125, and 127 as well as the pivot linkage members 104, 108, 116, and 120. The pivot pin 128 has a head 130 and a shaft 138 having a distal end 132 that may include a hollow interiorly threaded portion that allows the pivot pin 132 to be secured to the pivot linkage members 104, 108, 116, and 120 via threadable engagement with a retaining fastener 134 having complementary threads 136. A spring 126 can be engaged by a friction fit to the upwardly and downwardly extending pins 114 and 124 as shown in FIGS. 7 and 8. As such, the first and second sleeve members 101 and 103 can pivot relative to each other about the pivot pin 128 and against the bias of the spring 126 to open and close the sleeve 56*a* as will be discussed in more detail below.

In operation, the food products 60 such as crackers are fed via the transport troughs 50*a*-50*d* into the four accumulator cylinders 32*a*-32*d* as shown in FIG. 1. As the food products 60 are being advanced down the transport troughs 50*a*-50*d* into the respective openings 31*a*-31*d* of the accumulator cylinders 32*a*-32*d*, the rod 52 of the air cylinder 54, shuttle plate 40, and sleeves 56*a*-56*d* are in their initial positions shown in FIGS. 3 and 9.

Figure 9:
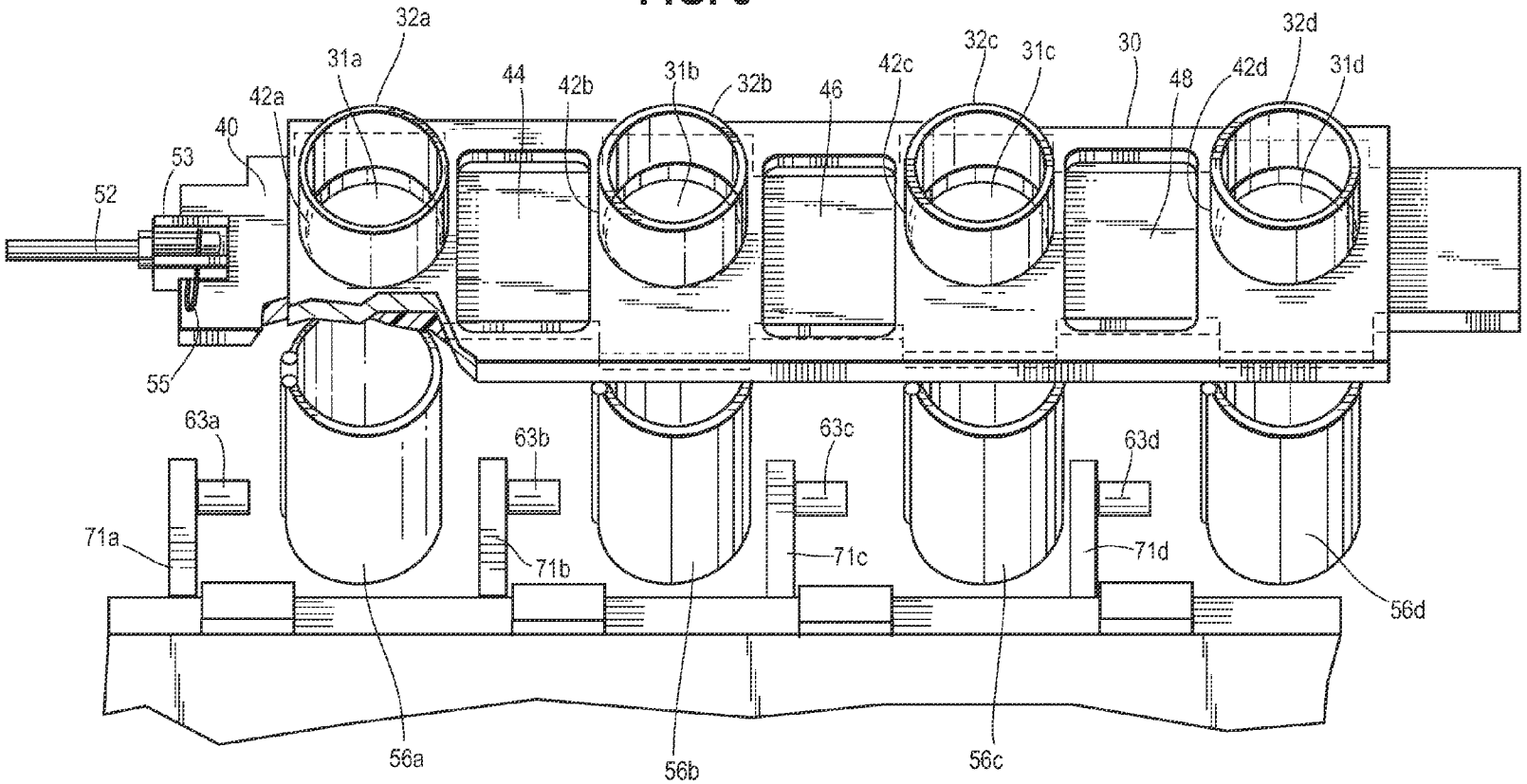
FIG. 9 is a perspective enlarged view of the rotating sleeves, accumulator plate, and the shuttle plate in an open position.

With reference to FIG. 9, when the rod 52 of the air cylinder 54, the shuttle plate 40, and the sleeves 56*a*-56*d* are in their initial positions, the openings 31*a*-31*d* of the accumulator cylinders 32*a*-32*d* are aligned with the openings 42*a*-42*d* of the shuttle plate 40 and with the hollow interiors 109 of each of the sleeves 56*a*-56*d*. This alignment of the openings 31*a*-31*d* of the accumulator cylinders 32*a*-32*d* and the openings 42*a*-42*d* of the shuttle plate 40 provides a passage that permits the food products 60 to pass singly (i.e., one by one) through the openings 31*a*-31*d* and the openings 42*a*-42*d* and through the first ends 131 of the respective sleeves 56*a*-56*d*. The food products 60 thus singly enter into the hollow interior 109 of a respective sleeve 56*a*-56*d* until a stack of eight food products 60 is accumulated in each sleeve 56*a*-56*d*.

Since the speed of the crackers 60 along the transport troughs 50 is known, the air cylinder 54 is configured to retract the cylinder rod 52 at predetermined time intervals so as to permit only eight food products 60 to accumulate in each sleeve 56*a*-56*d*. The retraction of the cylinder rod 52 in the direction shown in FIG. 10 causes the shuttle plate 40 to move such that the openings 42*a*-42*d* of the shuttle plate 40 are shifted out of alignment with the openings 31*a*-31*d* of the accumulator cylinders 32*a*-32*d*. The narrowed sections 46*b*-46*e* of the shuttle plate 40 also shift to underlie the openings 31*a*-31*d* of the accumulator cylinders 32*a*-32*d* at least in part, and obstruct the further travel path of the food products 60 as they exit the openings 31-31*d*. As a result, the food products 60 are temporarily prevented from dropping into the hollow interior 109 of a respective sleeve 56*a*-56*d*, and become stacked on the narrowed sections 46*b*-46*e* of the shuttle plate 40 and at least in part within the accumulator cylinders 32*a*-32*d*.

It will be appreciated that while the cylinder rod 52 of the air cylinder 54 is configured to retract to prevent additional food products 60 from entering the sleeves 56*a*-56*d* after eight of the food products 60 have been deposited into the sleeves 56*a*-56*d*, the air cylinder 54 could be configured to retract the rod 52 at other predetermined time intervals, allowing less than eight (e.g., 7, 6, or less) or more (e.g., 10, 12, or more) than eight food products 60 to be stacked in each of the sleeves 56*a*-56*d*. Further, it will be appreciated that while in one approach, an equal number of the food products 60 can be stored in each sleeve 56*a*-56*d*, in another approach, each of the accumulator cylinders 32*a*-32*d*, the reciprocation of the air cylinder rod 52, and the sizes of the sleeves 56*a*-56*d* may be varied such each of the sleeves 56*a*-56*d* can receive a different number of food products 60 therein.

Figure 11:
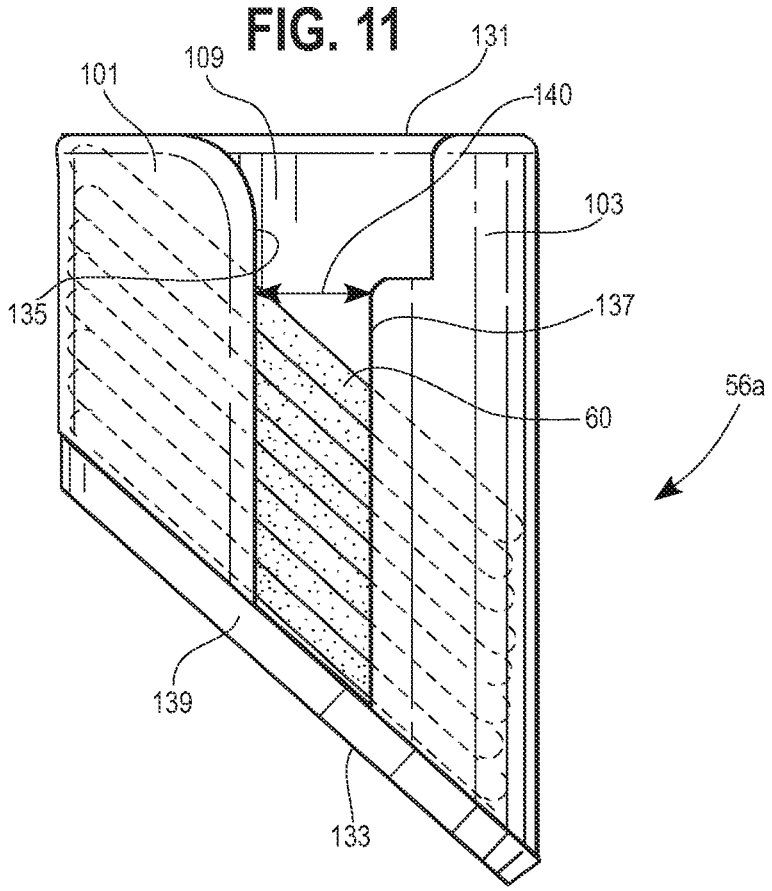
FIG. 11 is a side elevational view of the rotating sleeve, shown with the food products stacked in a shingled orientation.

With reference to FIG. 11, the representative sleeve 56*a* is shown with a stack of eight food products 60 received therein. The distal end 133 of the sleeve 56*a* has a configuration that orients the stack food products 60 stored therein in a predetermined orientation, for example, a shingled orientation shown in FIG. 11. In particular, the distal end 133 of the sleeve 56*a* includes at least one projecting abutment member 139 that obstructs at least a portion of the hollow interior 109 of the sleeve 56*a* to prevent the stacked food products 60 from exiting the sleeve 56*a* through the distal end 133.

The projecting abutment member 139 can be made from a plastic or metallic material and can be inclined at an angle of 45° to the horizontal, or at any other suitable angle (e.g., an angle that is less than or greater than 45°) to produce a shingled orientation of the food products 60 located within the hollow interior 109 of the sleeve 56*a*. Due to the angled orientation of the projecting abutment member 139, the bottom one of the food products 60 deposited into the hollow interior of the sleeve 56*a* can come to rest on the projecting abutment member 139 in an angled orientation which is substantially parallel to the projecting abutment member 139, in turn resulting each additional food product 60 fed into the sleeve 56*a* to become oriented in a shingled orientation as shown in FIG. 11.

The projecting abutment member 139 can be, for example, a single plate that is removably coupled to or fixedly attached to one or both of the sleeve members 101 and 103. It is to be appreciated that instead of a single plate, the distal end 133 of the sleeve 56*a* may optionally include a projecting abutment member 139 in the form of multiple spaced plates, protruding lips, ridges, a shoulder, or any other projection suitable for blocking the stack of the food products 60 from passing through the distal end 133 of the sleeve 56*a*, and for orienting the stack of the food products 60 in the sleeve 56*a* in a shingled orientation.

With reference to FIG. 11, when the sleeve 56*a* is in a closed position configured to securely hold the stack of the food products 60 therein, the edges 135 and 137 of the first and second sleeve members 101 and 103 are spaced apart such that a gap or an opening 140 is formed in the perimeter of the sleeve 56*a*. With the sleeve 56*a* being closed, the size of the gap 140 is less than the maximum dimension of the food products 60 such that the stacked food products 60 are restricted from exiting the sleeve 56*a* through the gap 140 as shown in FIG. 11. The maximum cross-sectional dimension of the hollow interior 109 of the sleeve 56*a* is substantially equal to the maximum dimension (e.g., a diameter) of the food products 60 such that the food products 60 are securely clamped by the sleeve members 101 and 103. As such, the food products 60 can be maintained by the sleeve 56*a* in the desired shingled orientation when the sleeve 56*a* rotates from the first position shown in FIG. 3 to the second position shown in FIG. 4, as discussed in more detail below.

With eight food products 60 such as crackers or cookies stacked and oriented in a shingled orientation within each sleeve 56*a*-56*d*, the sleeves 56*a*-56*d* are rotated from the substantially vertical orientation shown in FIG. 11 to a substantially horizontal orientation shown in FIG. 14. In particular, as the rod 76 of the air cylinder 78 moves from the extended position shown in FIG. 3 toward the retracted position shown in FIG. 4, the linkage member 58 moves in a direction toward the side wall 26 of the housing 20. As discussed above, this movement of the linkage member 58 causes the sleeves 56*a*-56*d* to rotate from the first position downward toward the second position and the stop members 63*a*-63*d*.

Figure 12:
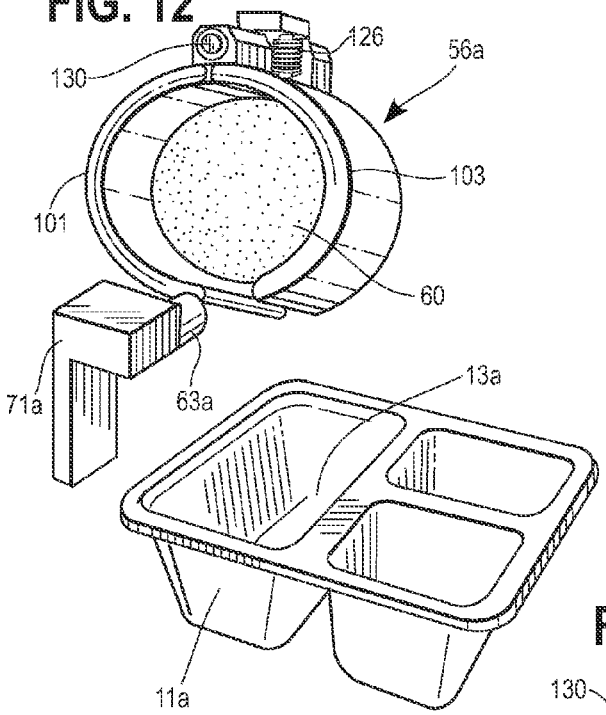
FIG. 12 is a side perspective view of a rotating sleeve, shown partially rotated from the food product receiving position toward the food product dispensing position.

FIGS. 12-14 show the rotation of only one representative sleeve 56*a*, but it will be appreciated that the sleeves 56*b*-56*d* rotate the same way. With reference to FIG. 12, when the sleeve 56*a* rotates, the sleeve members 101 and 103 are urged toward a closed position shown in FIG. 11 by the biasing effect of the spring 126. During the rotation of the sleeve 56*a*, the projecting abutment member 139 maintains the stack of the food products 60 in the shingled orientation shown in FIG. 11. Also, the sleeve members 101 and 103 maintain contact with the stack of the food products 60 and restrict the food products 60 from moving within the hollow interior 109, which can prevent the food products 60 from being displaced from the desired shingled orientation.

As the sleeve 56*a* is rotated toward the second position and the rotation approaches approximately 90 degrees from the first position shown in FIG. 3, the interior surface of sleeve member 103 comes into contact with the stop member 63*a* as shown in FIG. 13. Since the first and second sleeve members 101 and 103 of the sleeve 56*a* are spring-biased, the initial contact of the sleeve member 103 with the stop member 63*a* does not prevent further downward movement of the sleeve 56*a*. Instead, the downward force causing the sleeve 56*a* to rotate against the fixed stop member 63*a* causes the first and second sleeve members 101 and 103 of the sleeve 56*a* to begin to open by moving against the bias of the spring 126.

As the sleeve 56*a* begins to open, the edges 135 and 137 of the sleeve members 101 and 103 pivot away from one another until the spring 126 is fully compressed and the sleeve 56*a* is fully open as shown in FIG. 14. With the sleeve 56*a* being fully open, the edges 135 and 137 of the sleeve members 101 and 103 are spaced apart a sufficient distance such that the opening 140 provides enough clearance for the stack of the food products 60 to be unloaded from the interior 109 of the sleeve 56*a* and dispensed through the opening 140 of the sleeve 56*a* into an underlying cell 13*a* of a food tray 11*a*, as shown in FIG. 14.

The movement of the conveyor 94 that transports the trays 11*a*-11*d* and the reciprocation of the rods 52 and 76 of the air cylinders 54 and 78 are timed such that the trays 11*a*-11*d* can be positioned under the sleeves 56*a*-56*d* that have been rotated to the dispensing position shown in FIG. 14. As shown in FIG. 14, the sleeves 56*a*-56*d* are positioned in close proximity to the trays 11*a*-11*d* when the sleeves dispense the food products 60. As referenced above, the close proximity of the sleeves 56*a*-56*d* to the cells 131-13*d* of the trays 11*a*-11*d* and the ramp-like shape of the interiors of the sleeve members 101 and 103 of the selves 56*a*-56*d* permit the stacks of the food products 60 to maintain their shingled orientation as they are being deposited into the trays 11*a*-11*d*. The resulting shingled arrangement of the stack of the food products 60 in the food tray 11*a* shown in FIG. 14 is visually appealing to the consumers and permits the consumers to easily remove one of the food products 60 from the food tray 11*a* when desired.

After the sleeves 56*a*-56*d* dispense the stacks of eight shingled food products 60 into the trays 11*a*-11*d*, respectively, the rod 72 of the air cylinder 78 reciprocates back to the extended position, causing the linkage member 58 to move back in a direction toward the side wall 24 of the housing 20. This causes the empty sleeves 56*a*-56*d* to rotate back from the second position toward the first, food product receiving position shown in FIG. 3, where they receive eight more food products 60 that have been stacked on the shuttle plate 40 and at least in part within the passage of the accumulating cylinders 32*a*-32*d* as discussed above.

Figure 10:
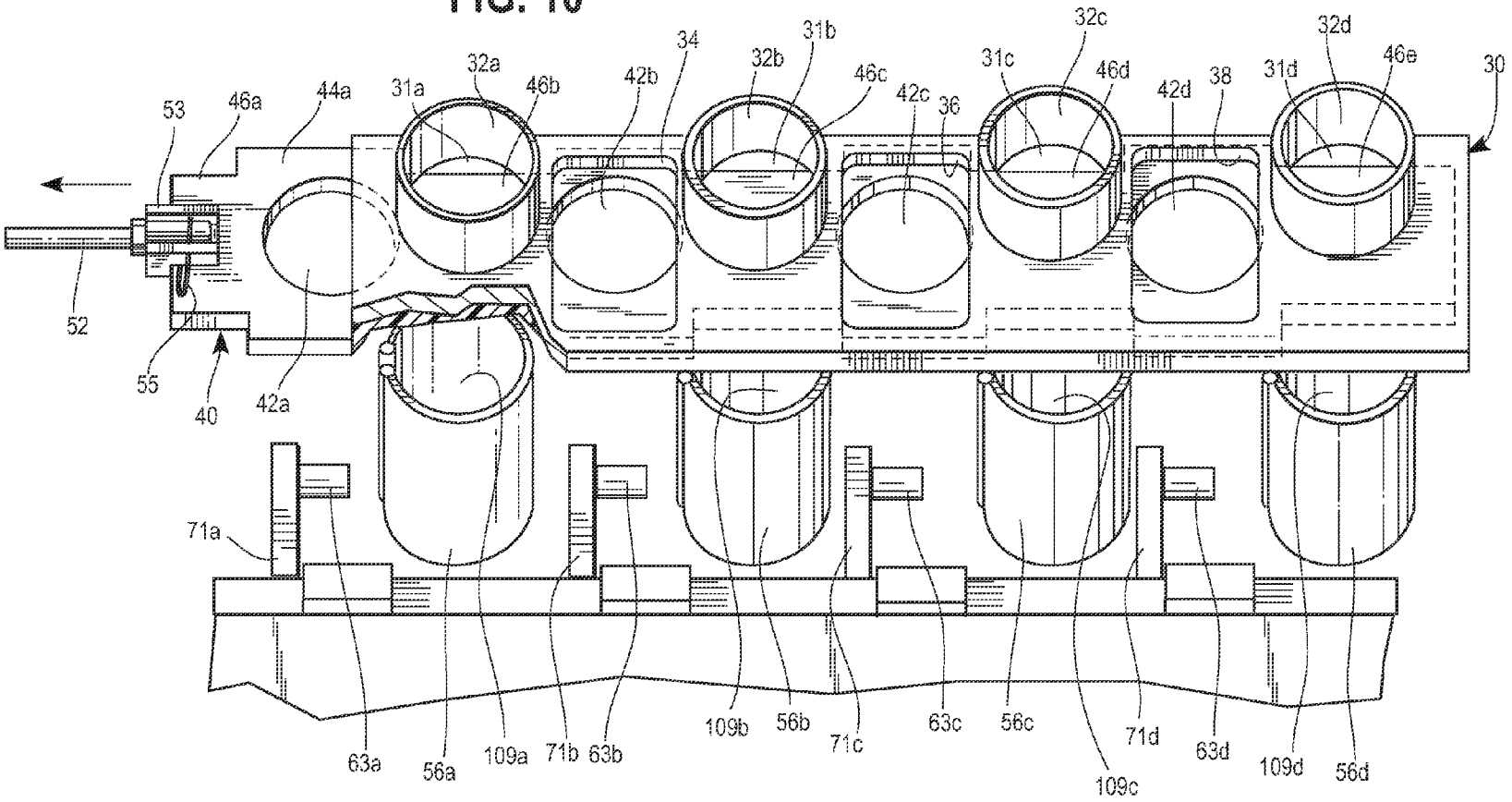
FIG. 10 is a perspective enlarged view of the rotating sleeves, accumulator plate, and the shuttle plate in a closed position.

When the sleeves 56*a*-56*d* return to the position shown in FIG. 3, the rod 52 of the air cylinder 54 reciprocates back to the extended position to cause shuttle plate 40 to move from the position shown in FIG. 10 to the position shown in FIG. 9, allowing eight additional food products 60 such as crackers to drop singly into each of the sleeves 56*a*-56*d*. The sleeves 56*a*-56*d* stack the food products 60 in shingled stacks, rotate toward the second position to deposit these stacks of shingled food products 60 into new food trays 11*a*-11*d*, and return back to their food product receiving positions as discussed above. The trays 11*a*-11*d* with the shingled food products 60 can travel down the conveyor 94 for further packaging such as an application of a lid.

The presentation of the food products 60 in a shingled orientation in the food trays 11*a*-11*d* is visually attractive and the food products 60 fill most of the available space in the cells 13*a*-13*d* of the food trays 11*a*-11*d*. It is to be appreciated that while the sleeves 56*a*-56*d* rotate approximately 90 degrees from the food product receiving position to the food product dispensing position, it is to be appreciated that the sleeves 56*a*-56*d* could initially be angled, not vertical, and could rotate by more or less then 90 degrees between the receiving position and the dispensing position. Furthermore, it will be appreciated that while the sleeves 56*a*-56*d* have been illustrated with an projecting abutment member 139 that is angled and results in a shingled orientation of the food products, the projecting abutment member 139 could also be horizontal, resulting in an orientation where the food products are not shingled, but are entirely coaxial with one another.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the concept.

The invention claimed is:

1. A method of placing food products into food trays, the method comprising:

placing the food products one-by-one into a rotatable sleeve to form a stack of the food products in the rotatable sleeve in a first position;

rotating the stack of the food products in the rotatable sleeve from the first position to a second position to place the stack of the food products in the rotatable sleeve over a food tray, the stack in the second position being non-parallel to the stack in the first position; and simultaneously depositing the stack of the food products from the second position and from the rotatable sleeve into the food tray by dropping the stack of the food products from the rotatable sleeve directly into the food tray.

2. The method of claim 1, wherein the placing of the food products one-by-one into the rotatable sleeve to form the stack includes orienting each of the food products in the stack in an orientation where each of the food products in the stack has inclined upper and lower surfaces.

3. The method of claim 2, wherein the rotating the stack of the food products in the rotatable sleeve from the first position to the second position includes maintaining the stack of the food products in the rotatable sleeve in the orientation where each of the food products in the stack has inclined upper and lower surfaces.

4. The method of claim 2, wherein the depositing the stack of the food products from the second position and from the rotatable sleeve includes positioning the stack of the food products from the rotatable sleeve into the food tray in the orientation where each of the food products in the stack has inclined upper and lower surfaces.

5. The method of claim 1, wherein the rotating the stack of the food products in the rotatable sleeve from the first position to the second position includes bringing the food products in the stack of food products closer to the food tray and in the rotatable sleeve when in the second position as compared to when in the first position.

6. The method of claim 1, wherein the placing of the food products one-by-one into a rotatable sleeve to form the stack of the food products in the first position further comprises providing a movable plate including at least one opening, and moving the movable plate to a first position that permits the food products to pass one-by-one through the at least one opening of the movable plate and into the rotatable sleeve to form the stack of the food products in the first position.

7. The method of claim 6, further comprising moving the movable plate to a second position where a portion of the food products, separate from the stack of the food products in the first position, are positioned on the movable plate.

8. The method of claim 7, wherein the placing of the food products one-by-one into a rotatable sleeve to form the stack of the food products in the rotatable sleeve in the first position further comprises providing a fixed plate and maintaining the portion of the food products within a hollow passage formed in the fixed plate.

9. The method of claim 1, wherein the simultaneously depositing the stack of the food products from the second position into the food tray further comprises orienting the stack of the food products in the food tray such that a portion of a lower surface of a first one of the food products in the food tray overlies a portion of an upper surface of an adjacent, second one of the food products and a portion of the lower surface of the first one of the food products does not overlie a portion of the upper surface of the second one of the food products.

10. The method of claim 1, wherein the stack in the second position is perpendicular relative to the stack in the first position.

11. An apparatus for placing food products into a food tray comprising:

at least one sleeve having a first end configured to receive food products one-by-one and an at least partially closed second end opposite the first end, the at least one sleeve having a first position where the food products are receivable one-by-one through the first end to form a stack having a predetermined orientation in the at least one sleeve, the at least one sleeve being configured to rotate from the first position to a second position where the food products are positioned over the food tray and simultaneously unloaded into the food tray by being dropped from the at least one sleeve directly into the food tray in the predetermined orientation through an opening positioned between the first and second ends.

12. The apparatus of claim 11, wherein the at least one sleeve includes at least one abutment surface configured to orient the stack of food products in an orientation where upper and lower surfaces of each of the food products in the stack are oriented parallel to the at least one abutment surface.

13. The apparatus of claim 11, wherein the food products in the stack are positioned closer to the food tray when the at least one sleeve is in the second position as compared to when the at least one sleeve is in the first position.

14. The apparatus of claim 11, wherein the at least one sleeve comprises at least first and second longitudinally extending portions configured to move away from one another to form the opening positioned between the first and second ends.

15. The apparatus of claim 14, wherein the first and second longitudinally extending portions are biased toward a closed position.

16. The apparatus of claim 14, wherein the first and second longitudinally extending portions are hinged relative to one another.

17. The apparatus of claim 11, wherein the at least one sleeve has a hollow interior with a circular cross-section.

18. The apparatus of claim 11, further comprising a stop member configured to contact the at least one sleeve and restrict the at least one sleeve from rotating past the second position.

19. The apparatus of claim 11, further comprising a movable plate including at least one opening therein, the movable plate being movable from the first position that permits the food products to enter into the at least one sleeve one-by-one through the at least one opening of the movable plate to form the stack, and the second position that restricts the stack of food products from entering the at least one sleeve.

20. The apparatus of claim 19, wherein the movable plate overlies at least a portion of the at least one sleeve and a portion of the food products, separate from the stack of food products, is positioned on the movable plate.

21. The apparatus of claim 11, wherein the at least one sleeve is configured to rotate and simultaneously deposit the food products into the food tray such that a portion of a lower surface of a first one of the food products in the food tray overlies a portion of an upper surface of an adjacent, second one of the food products and a portion of the lower surface of the first one of the food products does not overlie a portion of the upper surface of the second one of the food products.

22. The apparatus of claim 11, wherein the at least one sleeve further comprises a first sleeve member and a second sleeve member pivotally coupled to the first sleeve member, each of the first and second sleeve members having an upper edge and a lower edge defining the opening between the first and second ends of the at least one sleeve, the lower edges of each of the first and second sleeve members being positioned such that the opening between the first and second ends of the at least one sleeve does not provide clearance for the food products to be unloaded from the at least one sleeve when the at least one sleeve is in the first position, and wherein the lower edges of each of the first and second sleeve members are positioned further away from each other such that the opening between the first and second ends of the at least one sleeve provides clearance for the food products to be unloaded from the at least one sleeve when the at least one sleeve is in the second position.

* * * * *